US009297581B2

(12) United States Patent
Wang et al.

(10) Patent No.: US 9,297,581 B2
(45) Date of Patent: Mar. 29, 2016

(54) CENTRIFUGE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Qi Wang, Shenzhen (CN); Sui-Mang Song, Shenzhen (CN); Neng-Rong Wang, Shenzhen (CN); Xiao-Gang Peng, Shenzhen (CN); Tai-Yan Xia, Shenzhen (CN); Qiong Xie, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 118 days.

(21) Appl. No.: 14/297,837

(22) Filed: Jun. 6, 2014

(65) Prior Publication Data

US 2014/0360039 A1 Dec. 11, 2014

(30) Foreign Application Priority Data

Jun. 6, 2013 (CN) ..... 2013 1 0223013

(51) Int. Cl.
*F26B 11/00* (2006.01)
*F26B 5/08* (2006.01)

(52) U.S. Cl.
CPC ..... *F26B 5/08* (2013.01)

(58) Field of Classification Search
CPC ..... F26B 11/00; F26B 11/06; F26B 21/00; F26B 23/00; F26B 25/00; B04B 11/00; B04B 11/04
USPC ..... 34/58, 501, 208, 210; 210/85, 143, 375; 494/11, 38, 42
See application file for complete search history.

(56) References Cited

U.S. PATENT DOCUMENTS 2,328,394 A * 8/1943 Neuman ..... B04B 11/043 210/143
3,269,028 A * 8/1966 Strich ..... B04B 3/00 159/6.1

(Continued)

FOREIGN PATENT DOCUMENTS

DE 19631780 A1 * 2/1998 ..... B04B 7/02
DE WO 2010028638 A1 * 3/2010 ..... A61M 1/0209

(Continued)

*Primary Examiner* — Stephen M Gravini
(74) *Attorney, Agent, or Firm* — Novak Druce Connolly Bove + Quigg LLP

(57) ABSTRACT

A centrifuge includes a centrifuging compartment, a supporting assembly adjacent to the centrifuging compartment, a rotation mechanism mounted on the supporting assembly, and a feeding frame positioned in the centrifuging compartment. The centrifuging compartment includes a housing defining a inlet on a top thereof and a sealing cover pivotably coupling to the housing to cover the inlet. The supporting assembly includes a supporting portion positioned beside the housing and a base plate mounted on the supporting portion and located above the housing. The rotation mechanism rotatably extends through the top surface of the housing and the base plate, and coupling to a bottom surface of the housing. The feeding frame is positioned in the housing and coupling to the rotation mechanism, comprising a loading portion, and defining a positioning hole on a top thereof.

20 Claims, 7 Drawing Sheets

(56) References Cited

U.S. PATENT DOCUMENTS 3,829,009 A * 8/1974 Peck ..... B04B 11/02 494/11
4,077,135 A * 3/1978 Tzschoppe ..... B01D 3/08 34/593
4,193,874 A * 3/1980 Gerteis ..... B04B 3/025 210/232
5,746,915 A * 5/1998 Ebeling ..... B04B 9/12 210/360.1
6,412,191 B1 * 7/2002 Moyls ..... F26B 17/107 198/493
7,908,764 B1 * 3/2011 Estes ..... B04B 3/04 34/58
8,215,028 B2 * 7/2012 Eia ..... E21B 21/066 166/335
2004/0108281 A1 * 6/2004 Gerteis ..... B04B 3/02 210/781
2014/0360039 A1 * 12/2014 Wang ..... F26B 5/08 34/58

FOREIGN PATENT DOCUMENTS

GB 1325413 A * 8/1973 ..... B04B 1/12
JP 2009262104 A * 11/2009
SE WO 9740941 A1 * 11/1997 ..... B04B 1/20

* cited by examiner

CENTRIFUGE

FIELD

The present disclosure relates to centrifuges, and particularly to industrial centrifuges.

BACKGROUND

A centrifuge can be used to separate liquids or substances from each other.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
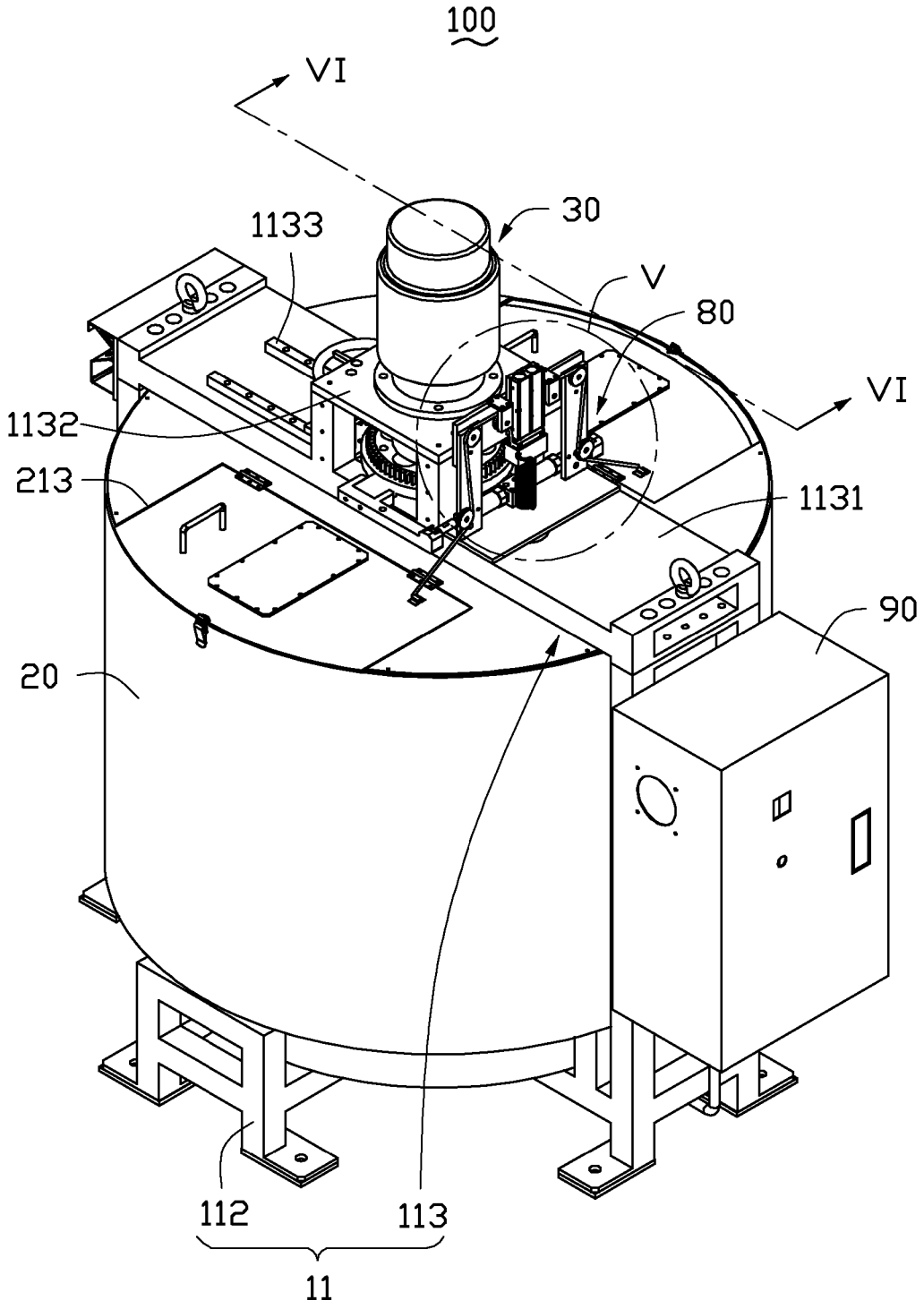
FIG. 1 is an isometric view of an embodiment of a centrifuge, the centrifuge including a rotation mechanism and a supporting assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to centrifuges, and particularly to industrial centrifuges.

A centrifuge configured to remove moisture from a workpiece, can include a supporting assembly, a centrifuging compartment, a rotation mechanism, a feeding frame, and an uncovering mechanism. The supporting assembly can include a supporting portion, and a base plate coupled to the supporting portion. The centrifuging compartment can include a housing having a top surface that forms at least one inlet, and at least one sealing cover pivotably coupled to the housing. The housing can be located beneath the base plate and adjacent to the supporting portion. The at least one sealing cover can be configured to cover a corresponding one of the at least one inlet. The rotation mechanism can be coupled to a bottom surface of the housing and configured to rotatably extend through the top surface of the housing and the base plate. The feeding frame can be coupled to the rotation mechanism and can be located within the housing. The feeding frame can include at least one loading portion configured to support and hold the workpiece. The feeding frame can further form a positioning hole corresponding to the at least one loading portion. The uncovering mechanism can be mounted on the supporting assembly, and can include a mounting frame coupled to the base plate, a driving member coupled to the mounting frame, at least one transmission belt coupled to the sealing cover and the driving rod, and a guiding rod coupled to the driving member. The driving member can include a driving rod coupled to the guiding rod. The at least one transmission belt can transmit motion from the driving rod to the sealing cover. The guiding rod can movably extend through the top surface of the housing. The driving rod can be configured to press the guiding rod to be inserted into the position hole to position the feeding frame, thereby aligning the workpiece to the inlet and simultaneously the driving rod cause the transmission belt to rotate the sealing cover to expose the inlet.

Figure 2:
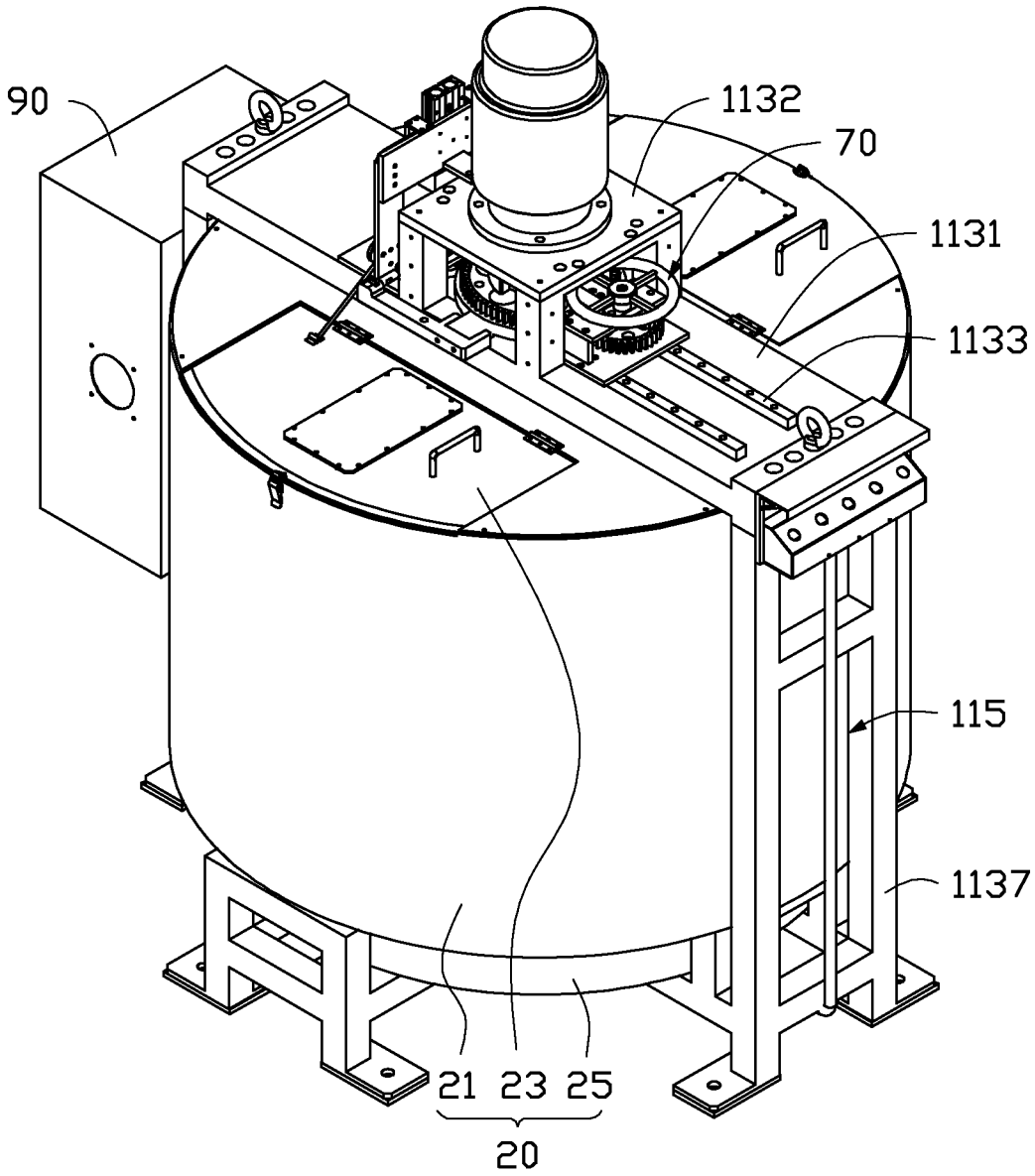
FIG. 2 is similar to FIG. 1, but viewed from another angle.

FIGS. 1-2 illustrate an embodiment of a centrifuge 100 configured to remove moisture from a workpiece 200. The centrifuge 100 can include a retaining frame 11, a centrifuging compartment 20, a rotation mechanism 30, a feeding frame 40, a braking mechanism 50, an adjusting mechanism 70, an uncovering mechanism 80, and a controller 90.

The retaining frame 11 can include a base 112, and a supporting assembly 113 mounted on the base 112. The supporting assembly 113 can include two supporting portions 1137 mounted on opposite sides of the base 112, a base plate 1131 mounted on the two supporting portions 1137, a mounting portion 1132 protruding from the base plate 1131, and two guiding rails 1133. The two guiding rails 1133 can be located on the base plate 1131 at a first side of the mounting portion 1132. The two supporting portions 1137 can extend substantially perpendicularly from respective opposite ends of the base 112. The base plate 1131 can span from one of the two supporting portions 1137 to the other supporting portion 1137. The base plate 1131 can be mounted above the base 112. The base plate 1131, the base 112, and the two supporting portions 1137 can cooperatively define a receiving space 115. The base plate 1131 can define a first through hole 1135 (see FIG. 7) at a second side of the mounting portion 1132 opposite to the first side. The mounting portion 1132 can be a hollow structure.

The centrifuging compartment 20 can be received in the receiving space 115 and be coupled to the base plate 1131 and the base 112. The centrifuging compartment 20 can include a housing 21, two sealing covers 23, and a collection box 25. The housing 21 can be substantially a hollow cylinder. The housing 21 can define a second through hole 212 (see FIG. 7) and two inlets 213 in a top surface thereof, and can further define a draining hole 215 (see FIG. 6.) in a bottom surface thereof. The second through hole 212 can extend to the first through hole 1135. The two inlets 213 can be defined at opposite sides of the top surface of the housing 21. The two sealing covers 23 can be pivotably coupled to the housing 21 and cover the two inlets 213, respectively. The collection box 25 can be received in the receiving space 115 and can be coupled to the bottom surface of the housing 21. The draining hole 215 can fluidly communicate with an inner space of the collection box 25, such that fluid contained in the housing 21 can flow through the draining hole 215 into the collection box 25.

Figure 3:
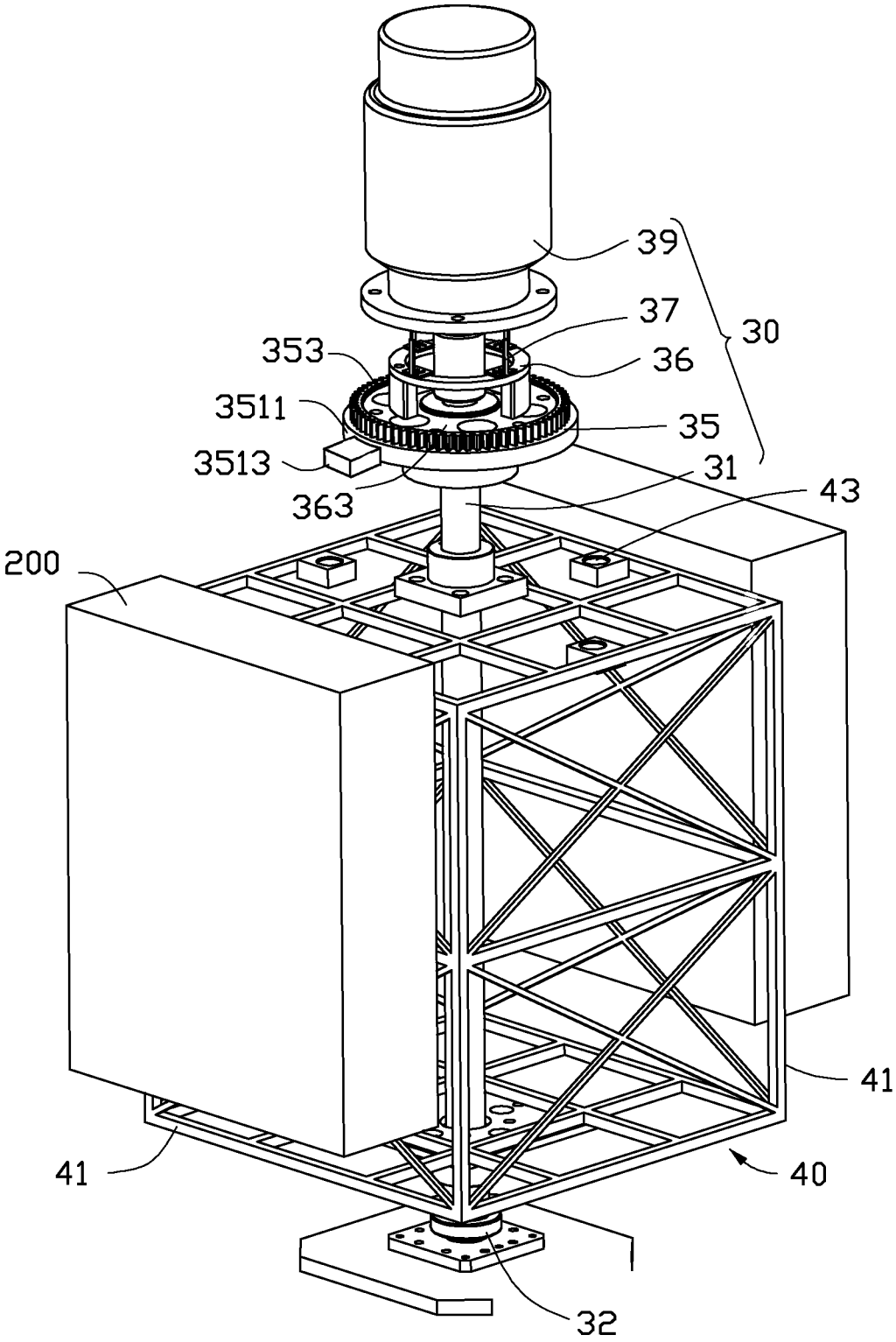
FIG. 3 is an isometric view of the rotation mechanism and the supporting assembly of the centrifuge of FIG. 1.
Figure 4:
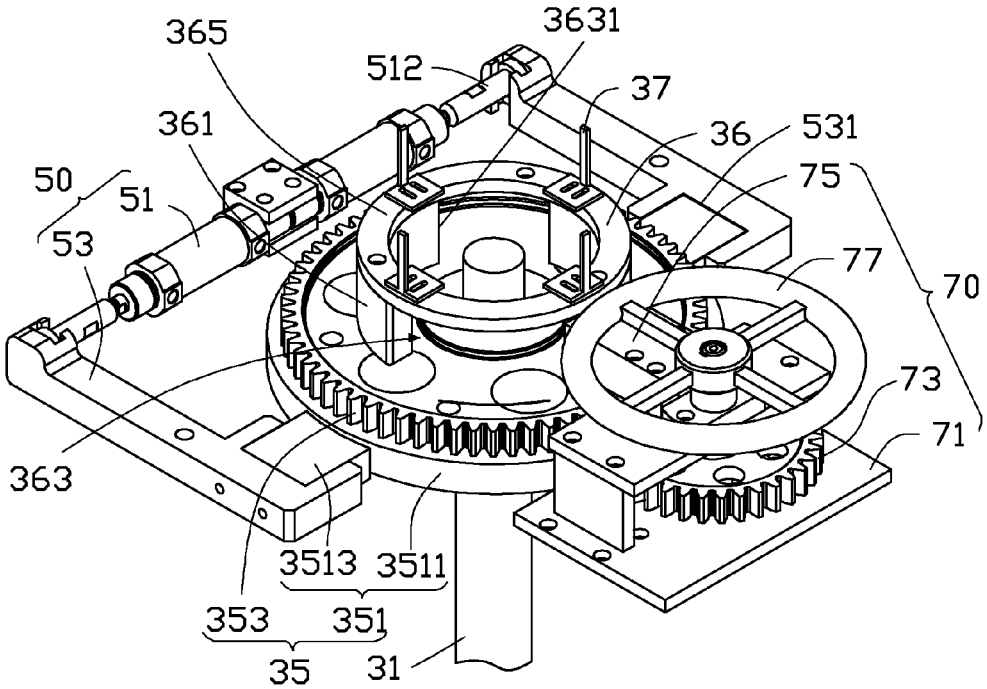
FIG. 4 is a partial isometric view of the centrifuge of FIG. 2.
Figure 6:
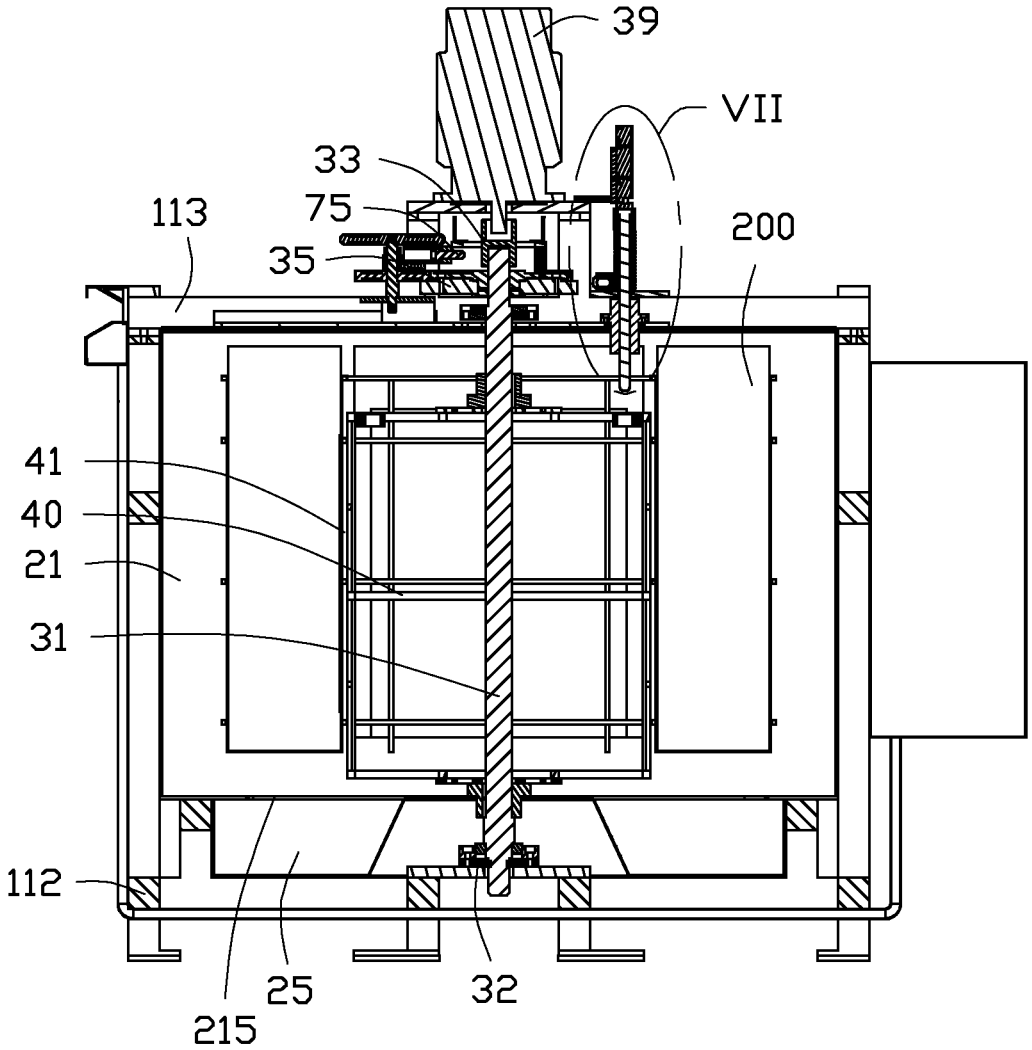
FIG. 6 is a cross-sectional view taken along line VI-VI of FIG. 1.

Referring to FIGS. 3, 4, and 6, the rotation mechanism 30 can include a shaft 31, an adjusting assembly 35, a bracket 36, four sensors 37, and a first driver 39. The shaft 31 can be inserted through the base plate 1131, the housing 21, the feeding frame 40, and the collection box 25, and finally pivotably couple to the base 112 by a bearing 32. The adjusting assembly 35 can sleeve on the shaft 31 and be received in the mounting portion 1132. The adjusting assembly 35 can include a braking wheel 351 and an adjusting wheel 353. The braking wheel 351 can include a main body 3511 mounted on the shaft 31, and two latches 3513 protruding from the main body 3511. The two latches 3513 can protrude from opposite sides of the main body 3511 and extend along a radial direction of the main body 3511. The adjusting wheel 353 can be coaxially positioned on the braking wheel 351. The bracket 36 can be mounted on the adjusting wheel 353. The bracket 36 can include a supporting wall 361, and a top surface 365 mounted on the supporting wall 361. Two cutouts 363 can be defined in opposite sides of the supporting wall 361, thereby dividing the supporting wall 361 into a first part (not labeled) and a second part (not labeled). In the illustrated embodiment, each cutout 363 can be bordered by the first part and the second part of the supporting wall 361. An angle of each cutout 363 can be about 90 degrees. The four sensors 37 can be mounted on the top surface 365 and be substantially evenly spaced from each other. The sensors 37 can sense a location of the workpieces 200 in the housing 21 and can determine if the workpieces 200 are aligned to the inlets 213. When the workpieces 200 are aligned to the inlets 213, the workpieces 200 can be removed from the housing 21. The first driver 39 can be mounted on the mounting portion 1132 and be coupled to the shaft 31 by a coupler 33.

The feeding frame 40 can be a substantially hollow rectangular frame. The feeding frame 40 can be received in the housing 21 and be mounted to the shaft 31. The feeding frame 40 can include two loading portions 41 on opposite sides thereof. Each loading portion 41 can correspond to one of the two latches 3513 and load one workpiece 200 thereon. A top of the feeding frame 40 can define two positioning holes 43 corresponding to the two loading portions 41, respectively. The first driver 39 can drive the shaft 31 to rotate, thus rotating the feeding frame 40 relative to the retaining frame 11. As the feeding frame 40 rotates, moisture adhering to the workpieces 200 can be thrown off under a centrifugal force generated by rotation of the feeding frame 40. The moisture thrown off of the workpieces 200 can collect on inner surfaces of the housing 21 and flow down to the draining hole 215, and finally flow into the collection box 25.

The braking mechanism 50 can include a second driver 51 and two braking rods 53. The second driver 51 can be mounted on the base plate 1131. Two driving shafts 512 can be mounted to two ends of the second driver 51, respectively. Each braking rod 53 can be mounted to a corresponding driving shaft 512. The two braking rods 53 can be positioned at opposite sides of the braking wheel 351. Each braking rod 53 can define a latching notch 531. Each latching notch 531 can engage with a corresponding latch 3513. When the braking wheel 351 and the shaft 31 are stopped from rotating, the second driver 51 can drive the two braking rods 53 to move towards the braking wheel 351, such that the latching notches 531 can be aligned to and engage with the corresponding latches 3513, thus preventing the braking wheel 351 and the shaft 31 from rotating.

The adjusting mechanism 70 can include a sliding base 71, an operating wheel 73, a limiting member 75, and a handle 77. The sliding base 71 can be slidably positioned on the two guiding rails 1133. The operating wheel 73 can be rotatably positioned on the sliding base 71. The limiting member 75 can partially protrude from the sliding base 71 and movably couple to the sliding base 71 via an elastic member (not shown). The limiting member 75 can extend into one of the cutouts 363 to resist the shaft 31 from rotating. The handle 77 can be coupled to the operating wheel 73. When the feeding frame 40 and the rotation mechanism 30 are stopped from rotating, if the workpieces 200 are not aligned to the inlets 213, the sliding base 71 can slide towards the adjusting wheel 353, until the operating wheel 73 meshes with the adjusting wheel 353. Then, the handle 77 can be rotated by an external force, thereby enabling the operating wheel 73 to drive the adjusting wheel 353 and the shaft 31 to rotate. The adjusting wheel 353 is rotated until the limiting member 75 can be inserted into one of the cutouts 363. When the limiting member 75 inserts into one of the cutouts 363, the adjusting wheel 353 can continue to rotate until the limiting member 75 resists against an edge of the first part or the second part of the supporting wall 361. As a result, the adjusting wheel 353 can be prevented from rotating, and the latches 3513 can be aligned to the latching notches 531. The second driver 51 can drive the two braking rods 53 to move towards the braking wheel 351, such that each latching notch 531 can engage with one corresponding latch 3513. Thus, the workpieces 200 can be aligned to the inlets 213, and the shaft 31 is prevented from moving.

Figure 5:
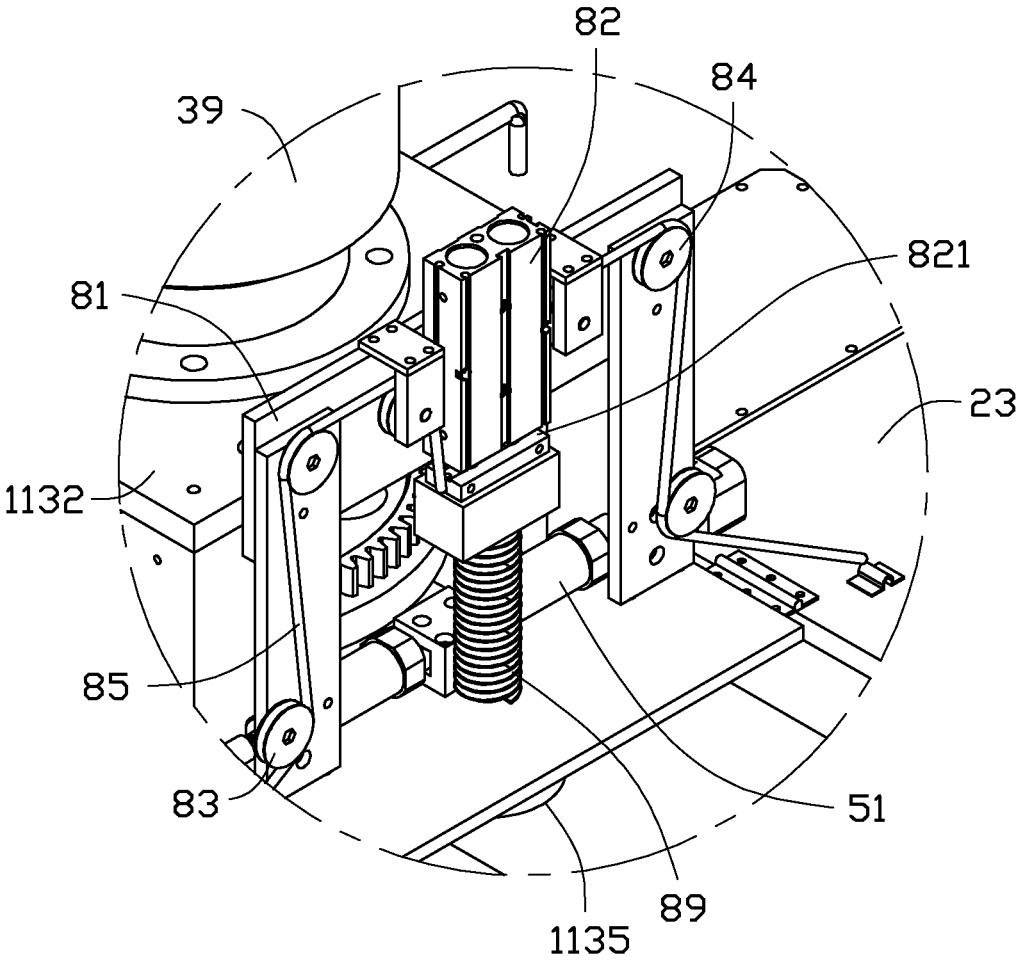
FIG. 5 is an enlarged isometric view of circled portion V of FIG. 1.
Figure 7:
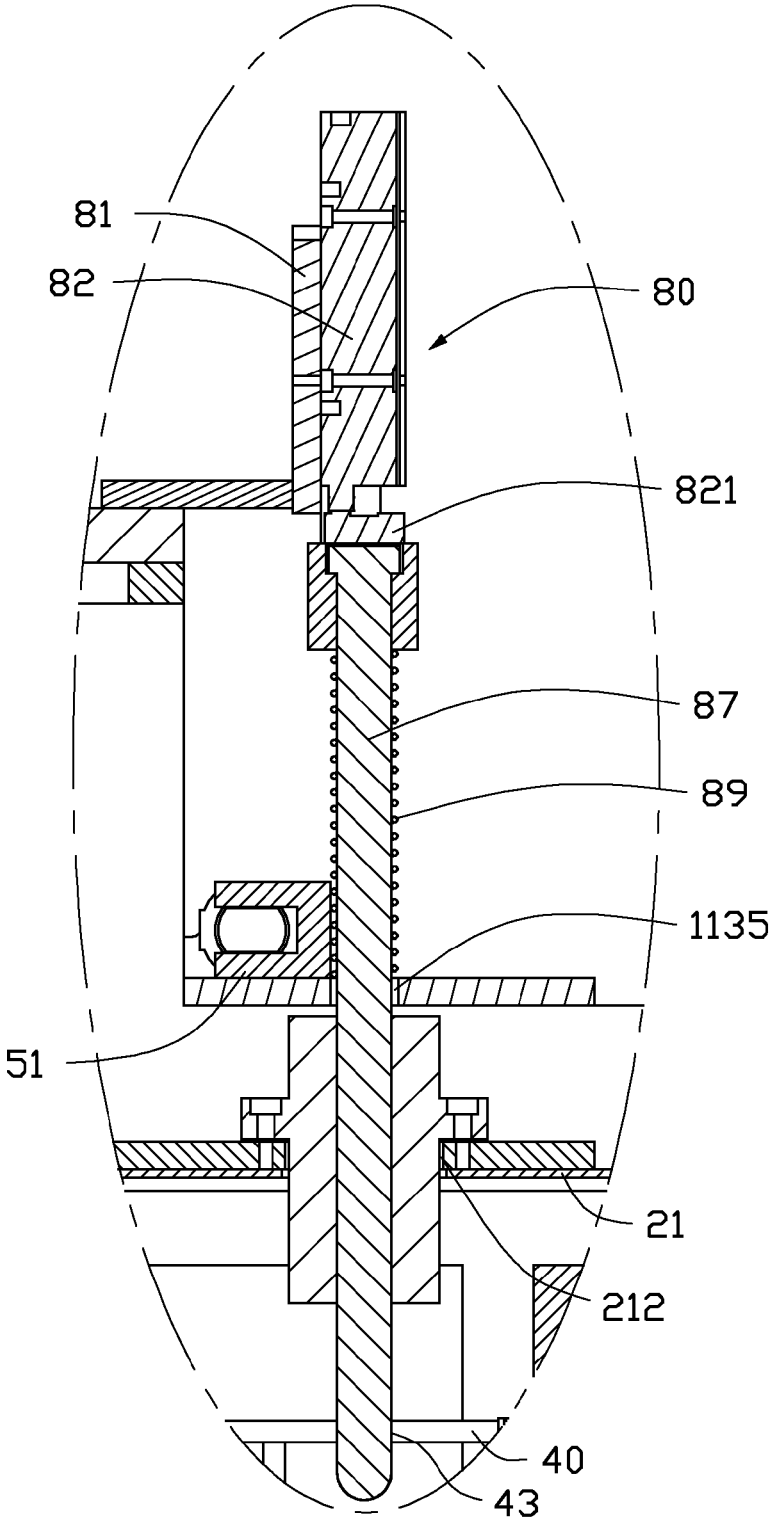
FIG. 7 is an enlarged cross-sectional view of circled portion VII of FIG. 6.

Referring to FIGS. 5-7, the uncovering mechanism 80 can include a mounting frame 81, a driving member 82, a guiding rod 87, three first tensioning wheels 83, three second tensioning wheels 84, and two transmission belts 85. The mounting frame 81 can be mounted to the first side of the mounting portion 1132. The driving member 82 can be mounted on the mounting frame 81 and can include a driving rod 821. The guiding rod 87 can be couple to to the driving rod 821 and can be movably inserted through the first through hole 1135 and the second through hole 212, and finally can be partially received in the housing 21. The three first tensioning wheels 83 and the three second tensioning wheels 84 can be mounted on the mounting frame 81. The three first tensioning wheels can be mounted adjacent to one end portion of the mounting frame 81 and be arranged substantially in an L-shape. The three second tensioning wheels 84 can be mounted adjacent to another end portion of the mounting frame 81 and be arranged substantially symmetrically to the three first tensioning wheels 83. Each transmission belt 85 can be coupled to one corresponding sealing cover 23. One of the transmission belts 85 can wind on the three first tension wheels 83 one-by-one and can be coupled to the driving rod 821. Another transmission belt 85 can wind on the three second tension wheels 84 one-by-one and can be coupled to the driving rod 821. The first tensioning wheels 83 and the second tensioning wheels 84 can be used to set a tension of the two transmission belts 85 wound thereon. The two transmission belts 85 can transmit motion from the driving rod 821 to the sealing cover 23. The driving member 82 can drive the driving rod 821 to move and pull the two transmission belts 85, thus opening the corresponding sealing covers 23, and the guiding rod 87 can guide a direction of the moving driving rod 821 and finally insert through one of the positioning holes 43 when pressed by the driving rod 821. In other alternative embodiment, the guiding rod 87 can be omitted.

The controller 90 can be mounted to one of the supporting portions 1137. The controller 90 can be electrically coupled to and control the sensors 37, the first driver 39, the second driver 51, and the driving member 82. The controller 90 can include a frequency converter (not shown) and a braking resistor (not shown). The first driver 39 can be started by the frequency converter, and can be stopped by the braking resistor.

In operation, the workpieces 200 can be loaded onto the loading portions 41. The controller 90 can control the first driver 39 to drive the shaft 31 and the feeding frame 40 to rotate rapidly. Moisture adhering to the workpieces 200 can be thrown off. The thrown off moisture can flow down to the draining hole 215, and finally flow into the collection box 25. The controller 90 can control the first driver 39 to stop rotating the shaft 31 after a predetermined time duration.

When the workpieces 200 are stopped from rotating and not aligned to the inlets 213, the sensors 37 can generate and transmit a signal to the controller 90, and the controller 90 can notify an operator. The operator can slide the sliding base 71 towards the adjusting wheel 353 until the operating wheel 73 meshes with the adjusting wheel 353. The adjusting wheel 353 can be rotated until the limiting member 75 inserts into one of the cutouts 363 and abuts against an edge of the first part or the second part of the supporting wall 361. Thus, the latches 3513 can be aligned to the latching notches 531. The controller 90 can control the second driver 51 to align and engage each latching notch 531 with one corresponding latch 3513. Therefore, the workpieces 200 can be aligned to the inlets 213, and the sensors 37 can signal the controller 90 to stop notifying the operator. Then, the controller 90 can control the driving member 82 to drive the driving rod 821 press the guiding rod 87 to be inserted into the position hole 43 to position the feeding frame 40, thereby aligning the workpiece 200 to the inlet 213 and simultaneously the driving rod 821 cause the transmission belts 85 to rotate the sealing cover 23 to expose the inlet 213. The workpieces 200 can be taken out of the housing 21. The controller 90 can control the driving member 82 to move back, thereby moving the guiding rod 87 out of the positioning hole 43, and causing the transmission belts 85 to loosen. The two sealing covers 23 can fall down by gravity, thereby covering the corresponding inlets 213.

In an alternative embodiment, the number of the guiding rails 1133, the inlets 213, the sensors 37, the braking rods 53, the driving shafts 512, the sealing covers 23, the transmission belts 82, the positioning holes 43, the first tensioning wheels 83, and the second tensioning wheels 84 can be changed according to actual needs.

In an alternative embodiment, the first tensioning wheels 83 and the second tensioning wheels 84 can be omitted, such that each transmission belt 85 can be coupled to the driving rod 821 directly. The base 112 can be omitted, such that the supporting portion 1137 can be positioned on the ground to support the base plate 1131, the housing 21 can be positioned on the ground, and an end of the shaft 31 can be coupled to a bottom surface of the housing 21. The collection box 25 can be omitted, such that the moisture flows out of the housing 21 directly.

It is believed that the present embodiments and their advantages will be understood from the foregoing description, and it will be apparent that various changes can be made thereto without departing from the scope of the embodiments or sacrificing all of its material advantages. The embodiments described herein all illustrative only, and should not be construed to limit the following claims.

What is claimed is:

1. A centrifuge configured to remove moisture from a workpiece, comprising:

a centrifuging compartment comprising:

a housing having a top surface that forms at least one inlet; and at least one sealing cover pivotably coupled to the housing, the at least one sealing cover configured to cover a corresponding one of the at least one inlet;

a supporting assembly adjacent to the housing, comprising:

a supporting portion positioned adjacent to the housing; and a base plate mounted on the supporting portion and located above the housing;

a rotation mechanism rotatably extending through the top surface of the housing and the base plate, and coupling to a bottom surface of the housing;

a feeding frame positioned in the housing and coupling to the rotation mechanism, the feeding frame comprising at least one loading portion configured to support and hold the workpiece, and defining a positioning hole corresponding to the at least one loading portion; and an uncovering mechanism mounted on the supporting assembly, comprising:

a mounting frame mounted on the base plate;

a driving member mounted on the mounting frame, comprising a driving rod;

at least one transmission belt, and opposite ends of the at least one transmission belt respectively coupling to the sealing cover and the driving rod; and a guiding rod coupling to the driving rod, and movably extending through the top surface of the housing, wherein, the driving rod is capable of pressing the guiding rod to insert into the positioning hole to position the feeding frame, thereby aligning the workpiece to the inlet, and simultaneously the driving rod cause the at least one transmission belt to rotate the sealing cover to expose the inlet.

2. The centrifuge of claim 1, wherein the supporting assembly further comprises a mounting portion protruding from the base plate; the rotation mechanism comprises a shaft, an adjusting assembly, and a first driver; the shaft movably extends through the base plate and the top surface of the housing, and couples to the bottom surface of the housing; the feeding frame sleeves on the shaft; the adjusting assembly sleeves on the shaft and is mounted on the mounting portion; the first driver is mounted on the mounting portion and couples to the shaft.

3. The centrifuge of claim 2, further comprising an adjusting mechanism movably positioned on the base plate, wherein the adjusting mechanism is adjacent to the adjusting assembly and meshes with the adjusting assembly, the adjusting mechanism is capable of driving the adjusting assembly and the shaft to rotate.

4. The centrifuge of claim 3, wherein the adjusting assembly comprises an adjusting wheel, the supporting assembly comprises a guiding rail mounted on the guiding rail adjacent to the mounting portion; the adjusting mechanism comprises a sliding base slidably positioned on the guiding rail, and an operating wheel mounted on the sliding base and being capable of meshing with the adjusting wheel.

5. The centrifuge of claim 4, wherein the rotation mechanism comprises a bracket mounted on the adjusting wheel, and at least one sensor mounted on the bracket; the sensor is capable of sensing a location of the workpiece supported on the feeding frame, and can check if the workpiece is aligned with the inlet.

6. The centrifuge of claim 5, wherein the bracket comprises a supporting wall coupling to the adjusting wheel, and a top surface mounted on the supporting wall; two cutouts can be defined in opposite sides of the supporting wall; the adjusting mechanism further comprises a limiting member movably positioned on the sliding base via a elastic member, and a handle coupled to the operating wheel; the limiting member is capable of extending into one of the two cutouts.

7. The centrifuge of claim 4, wherein the adjusting assembly comprises a braking wheel, the adjusting wheel is mounted on a side of the braking wheel.

8. The centrifuge of claim 7, further comprising braking mechanism, wherein the braking mechanism comprises a second driver and at least one braking rod; the second driver is mounted on the base plate adjacent to the mounting frame, and comprises at least one driving shaft, the at least one braking rod is mounted one corresponding driving shaft adjacent to the braking wheel; the second driver is capable of driving the at least one braking rod to move towards and engaging with the braking wheel to stop the braking wheel and the shaft from rotating.

9. The centrifuge of claim 8, wherein the braking wheel comprises a main body mounted on the shaft, and two latches protruding from the main body; each braking rod defines a latching notch on an end away from the corresponding driving shaft; the latching notch faces to the braking wheel, such that the latching notches can engage with the corresponding latch.

10. The centrifuge of claim 1, wherein the uncovering mechanism further comprises at least one tensioning wheel mounted on the mounting frame and adjacent to the driving member; the transmission belt winds on the tensioning wheel, and is tensioned by the tensioning wheel.

11. The centrifuge of claim 1, wherein the base plate defines a first though hole corresponding to the guiding rod; the housing defines a second through hole on the top thereof fluidly communicating with the first through hole; the guiding rod movably extends through the first through hole and the second through hole, and is partially received in the housing.

12. The centrifuge of claim 4, wherein the housing further comprises a collecting member coupling to the bottom surface of the housing; the housing defines a draining hole on the bottom thereof corresponding to and fluidly communicating with the collection box.

13. The centrifuge of claim 7, further comprising a controller mounted on the supporting portion and electrically coupling to the driving member, wherein the first driver, and the second driver; the controller is capable of controlling the first driver to drive/stop the shaft to rotate/from rotating, and capable of controlling the second driver to brake the rotating action of the shaft, and further capable of control the driving rod to press the guiding rod, such that, the guiding rod inserts through the positioning hole, and the driving rod drags the transmission belt to uncover the sealing cover.

14. A centrifuge 100, comprising:

a centrifuging compartment comprising a housing having a top surface that forms at least one inlet;

a supporting assembly adjacent to the housing, comprising:

a supporting portion positioned beside the housing; and a base plate mounted on the supporting portion and located above the housing, a rotation mechanism rotatably mounted on the top surface of the housing and the base plate;

a feeding frame positioned in the housing and coupling to the rotation mechanism, comprising a loading portion, and defining a positioning hole on a top thereof; and an uncovering mechanism mounted on the supporting assembly, comprising:

a mounting frame mounted on the base plate and being above the housing;

a driving member mounted on the mounting frame, comprising a driving rod extending towards the mounting portion;

a transmission belt, and opposite ends of the transmission belt coupling to the driving rod; and a guiding rod resisting against the driving rod, and movably extending into the housing and the positioning hole.

15. The centrifuge of claim 14, wherein the supporting assembly further comprises a mounting portion protruding from the base plate; the rotation mechanism comprises a shaft, an adjusting assembly, and a first driver; the shaft movably extends through the base plate and the top surface of the housing, and couple to the bottom surface of the housing; the feeding frame sleeves on the shaft; the adjusting assembly sleeves on the shaft and is received in the mounting portion; the first driver is mounted on the mounting portion and couples to the shaft.

16. The centrifuge of claim 15, further comprises an adjusting mechanism movably positioned on the base plate, the adjusting mechanism is adjacent to the adjusting assembly and mesh with the adjusting assembly.

17. The centrifuge of claim 16, wherein the adjusting assembly comprises an adjusting wheel, the supporting assembly comprises a guiding rail mounted on the guiding rail adjacent to the mounting portion; the adjusting mechanism comprises a sliding base slidably positioned on the guiding rail, and an operating wheel mounted on the sliding base being capable of meshing with the adjusting wheel.

18. The centrifuge of claim 17, wherein the rotation mechanism comprises a bracket mounted on the adjusting wheel, and at least one sensor mounted on the bracket.

19. The centrifuge of claim 18, wherein the bracket comprises a supporting wall coupling to the adjusting wheel, and a top surface mounted on the supporting wall; two cutouts can be defined in opposite sides of the supporting wall; the adjusting mechanism further comprises a limiting member movably positioned on the sliding base via a elastic member, and a handle coupled to the operating wheel; the limiting member is capable of extending into one of the two cutouts.

20. A centrifuge configured to remove moisture from a workpiece, the centrifuge comprising:

a supporting assembly comprising:

a supporting portion; and a base plate coupled to the supporting portion;

a centrifuging compartment comprising:

a housing having a top surface that forms a least one inlet, wherein the housing is located beneath the base plate and adjacent to the supporting portion; and at least one sealing cover pivotably coupled to the housing, the at least one sealing cover configured to cover a corresponding one of the at least one inlet;

a rotation mechanism coupled to a bottom surface of the housing, the rotation mechanism configured to rotatably extend through the top surface of the housing and the base plate;

a feeding frame coupled to the rotation mechanism and located within the housing, the feeding frame comprising at least one loading portion configured to support and hold the workpiece, and the feeding frame further forming a positioning hole corresponding to the at least one loading portion;

an uncovering mechanism mounted on the supporting assembly comprising:

a mounting frame coupled to the base plate;

a driving member coupled to the mounting frame and comprising a driving rod;

at least one transmission belt coupled to the sealing cover and the driving rod, wherein the at least one transmission belt transmits motion from the driving rod to the sealing cover; and a guiding rod coupled to the driving rod, the guiding rod movably extending through the top surface of the housing, wherein the driving rod is configured to press the guiding rod to be inserted into the position hole to position the feeding frame, thereby aligning the workpiece to the inlet and simultaneously the driving rod cause the transmission belt to rotate the sealing cover to expose the inlet.

* * * * *